United States Patent [19]

Meyer-Grünow

[11] Patent Number: 4,880,462

[45] Date of Patent: Nov. 14, 1989

[54] RAPIDLY DISSOLVING ADDITIVE FOR MOLTEN METAL METHOD OF MAKING AND METHOD OF USING

[75] Inventor: Hartmut Meyer-Grünow, Garching/Alz, Fed. Rep. of Germany

[73] Assignee: SKW Trostberg Aktiengesellschaft, Trostberg, Fed. Rep. of Germany

[21] Appl. No.: 194,950

[22] PCT Filed: Jul. 16, 1987

[86] PCT No.: PCT/EP87/00387

§ 371 Date: Mar. 9, 1988

§ 102(e) Date: Mar. 9, 1988

[87] PCT Pub. No.: WO88/00620

PCT Pub. Date: Jan. 28, 1988

[30] Foreign Application Priority Data

Jul. 16, 1987 [DE] Fed. Rep. of Germany ..... 3624005

[51] Int. Cl.[4] ..... C22C 1/05

[52] U.S. Cl. ..... 75/253; 75/68 R; 75/256; 420/528; 420/590

[58] Field of Search ..... 75/68 R, 253, 256; 420/129, 528, 590

[56] References Cited

U.S. PATENT DOCUMENTS

| | | | |
|---|---|---|---|
| 3,591,369 | 7/1971 | Tuthill | 420/528 |
| 3,865,583 | 2/1975 | Kline et al. | 420/528 |
| 3,865,584 | 2/1975 | Kline et al. | 75/231 |
| 3,941,588 | 3/1976 | Dremann | 75/253 |
| 4,564,393 | 1/1986 | Murray et al. | 75/68 R |

FOREIGN PATENT DOCUMENTS 5164073 8/1974 Australia .

*Primary Examiner*—Robert McDowell
*Attorney, Agent, or Firm*—Felfe & Lynch

[57] ABSTRACT

The present invention provides a rapidly dissolving additive for molten metal, wherein it contains 2 to 50% by weight of a component A, which consists of an alkali metal aluminium fluoride and/or an alkali metal aluminium fluoride-containing salt mixture, and 50 to 98% by weight of a component B, which consists of at least one alloying metal, the alloying metal being different from the base metal to be allied, the components A and B being present intimately mixed.

The present invention also provides a process for the production of this additive.

22 Claims, No Drawings

RAPIDLY DISSOLVING ADDITIVE FOR MOLTEN METAL METHOD OF MAKING AND METHOD OF USING

BACKGROUND OF THE INVENTION

The present invention is concerned with a rapidly dissolving additive for molten metal, a process for the preparation of said additive and its use for the introduction of alloying elements into metals.

In the production of metal alloys, in practice the alloying elements are usually added in solid form to a molten metal bath. Thus, for example, aluminium is alloyed with magnesium in order to achieve improved strengths, with silicon in order to improve the castability and the strength and with manganese and chromium in order to increase the strength and corrosion resistance. Furthermore, a whole series of further alloying elements are known for the purpose of influencing alloying properties. Under current general practice alloying elements, in particular the alloying metal, which has a higher melting point in comparison with the base metal, is added in the form of a pre-alloy in order to achieve a rapid dissolving. The disadvantage of this pre-alloying is the limited content of alloying metal. Thus, for example the standard prealloys for aluminium alloying contain, besides aluminium, only a maximum of 20% of silicon, up to 20% of chromium or up to 50% of manganese. Thus, up to 4 times the amount of aluminium must be added to the alloying element; this results in higher transport costs, storage costs, energy consumption and the like. In order at least partly to avoid these disadvantages, it is known from U.S. Pat. No. 3,592,637 to use mixtures of aluminium or silicon powder with powders of alloying metals or alloying metal alloys in briquet form. Thus, for example, alloying briquets with 25% aluminium and 75% of the metals chromium, manganese and iron are commercially available. The disadvantages of such alloying agent are the proportion of alloying element being limited to 75% and the low speed of dissolving. British Patent Specification No. 2,112,020 also describes similar mixtures in which a part of the aluminium is replaced by chloride or fluoride salts. Commercially available tablets containing chromium, manganese and iron also have only a limited speed of dissolving.

Therefore, it is an object of the present invention to provide an additive for metal melts which does not display the mentioned disadvantages of the prior art but which, also in the case of higher concentrations of alloying metal, makes possible a complete and rapid dissolving in a molten base metal.

SUMMARY OF THE INVENTION

Thus, according to the present invention, there is provided a rapidly dissolving additive for molten metal which contains 2 to 50% by weight of a component A, consisting of an alkali metal aluminium fluoride and/or of an alkali metal aluminium fluoridecontaining salt mixture, and 50 to 98% by weight of a component B, which consists of at least one alloying metal, this alloying metal being different from the base metal to be alloyed, the components A and B being present intimately mixed.

DETAILED DISCLOSURE

We have, surprisingly, found that the additives according to the present invention, even in the case of higher contents of alloying metal than correspond to the prior art, possess an unexpectedly high speed of dissolving with simultaneous complete utilisation of the alloying metal.

The rapidly dissolving additive for molten metals according to the present invention consists of 2 to 50% by weight of component A and 50 to 98% by weight of component B.

As component A, there can be used an alkali metal aluminium fluoride and/or an alkali metal aluminium fluoride-containing salt mixture provided that, in the case of the use of the additive according to the present invention, unacceptable amounts of impurities are not introduced into the base metal. Furthermore, the melting point of the salt or of the salt mixture should not lie above that of the base metal. Instead of an alkali metal aluminium fluoride, there can also preferably be used a mixture of an alkali metal fluoride and aluminium fluoride. As preferred alkali metal aluminium fluoride-containing salt mixtures, there are to be understood those mixtures of alkali metal aluminium fluorides and other salts, especially fluoride and/or chloride salts, in which the proportion of alkali metal aluminium fluoride amounts to at least 50% by weight. With regard to the alkali metal compounds, in principle, there can be used all alkali metal salts of aluminium fluoride but the sodium and/or potassium salts are preferable.

The proportion by weight of component A in the additive is to be as low as possible with simultaneous good dissolving properties of the alloying component(s). Depending upon the density of the alloying metal, even 2% by weight of component A is sufficient. In the range of from 5 to 25% by weight of component A, there is achieved the best combination of optimum speed of dissolving and maximum concentration of the alloying component in the additive. Preferably the component A is present in an additive according to the invention in an amount of 10 to 20% by weight.

The component B, which is present in the additive in an amount of from 50 to 98% by weight, preferably of from 75 to 95% by weight and most preferably of from 80 to 90% by weight, consists of at least one alloying metal. In principle, there can hereby be used all alloying elements but, because of the technical importance thereof, chromium, manganese and iron are especially preferred. However, other alloying elements, for example nickel, cobalt, copper, silver, titanium, zirconium, hafnium, vanadium, niobium, tantalum, molybdenum and tungsten, can also be present in the additive. The alloying metal does not have to be present in pure form; alloys or mixture of several metals can also be used provided that no undesirable impurities in the base metal are thereby brought about.

It is important for the present invention that not only component A but also component B are present in intimately mixed from. Preferably the additive is employed in a pressed or compacted form, for exmaple as briquets, tablets or pellets and the like, the size of these bodies being variable within wide limits. It is only important that the bodies possess, on the one hand, a sufficiently great speed of sinking in the metal bath in question and that, on the other hand, they do not have too great a thickness in order to provide for an acceptable speed of dissolving. The maximum thickness of the bodies an be taken as being 50 mm., the preferred range being from 5 to 25 mm.

As an alternative, the additive can also be present in the form of a filled wire, the agent being enveloped by an appropriate material. In the selection of the appropriate material, care is to be taken that it dissolves rapidly in the melt in order to liberate the additive and that is does not introduce any undesired impurities into the metal bath to be alloyed. It has proved to be especially advantageous to use the base metal in question.

The production of the additive according to the invention takes place by intimately mixing the pulverised components A and B and possibly by pressing with conventional technical devices, for example tabletting or briquet presses, or by introduction into a filled wire. The particle size of the component A should be <1 mm. and preferably <150 μm. and that of component B should also be <1 mm. and preferably <150 μm. in order, after subsequent pressing or compacting to give a formed body, to impart a sufficiently large internal surface area which, in turn, is of considerable importance for the speed of dissolving.

Since most metals, in the case of production by technically conventional processes, are not obtained in powder form, a previous comminution is necessary which, after breaking up, can comprise a milling procedure in conventional mills, such as ball, vibratory or impact mills.

The use of additive according to the present invention comprises adding said additive in an amount of from 0.01 to 25% by weight to the molten base metal, whereby it dissolves completely therein without the formation of residue and forms a homogeneous alloy.

As base metal, there can, in principle, be used all metals or alloys in which the elements introduced by the additive according to the present invention are tolerable. Light metal alloys, such as pure aluminium and aluminium alloys, as well as pure magnesium and magnesium alloys, in which the advantages such as high speed of dissolving and high concentration of alloying component manifest themselves especially clearly, are especially suitable.

The following Examples are given for the purpose of illustrating the present invention:

EXAMPLES 1 TO 6

30 kg. of aluminium (base metal) were heated to 800° C. in an induction crucible furnace. Due to the stored heat, the temperature loss during the experiment amounted to a maximum of 30° C. To the melt was added chromium (alloying component) in the form of various additives which consisted of pressed mixtures of the given components with a diameter of 25 mm. and a height of about 15 mm. The chromium addition corresponded to 0.5% of the aluminium. During the experiment, no electric power was fed into the furnace so that no inductive bath movement occurred. Directly after the addition of the chromium, the melt was stirred for 2 seconds. Subsequently, the first sample was taken after 2 minutes. After the sampling, stirring was again carried out for 2 seconds and, after 5 minutes, the next sample was taken. This cycle was repeated twice, with sampling after 10 and 15 minutes. Thereafter, the melt was stirred for 1 minute with subsequent sampling after 20 minutes.

For the mixture pressed bodies, there was used chromium powder <150 μm. and potassium aluminium tetrafluoride powder ($KAlF_4$) <150 μm., as well as aluminium powder with a grain size of 430–75 m. The intimate mixture was compressed in a tablet press to about 70–80% of the theoretical density. Furthermore, use was made of two commercially available products according to the prior art.

From the following Table, there can be seen the mixtures used, the density of the pressed bodies and the solubility behaviour. Experiments 1 to 3, in which additives according to the present invention were used, show the speed of dissolving in dependence upon the potassium aluminium fluoride content of the mixtures. As the experiments demonstrate, in the case of a potassium aluminium fluoride content of 14.1% by weight (cf. experiment 3), the chromium has already gone almost completely into solution after 2 minutes, whereas in the case of 9.1% by weight of potassium aluminium fluoride, after 10 minutes the chromium was dissolved almost completely in the base metal (cf. experiment 1).

Experiments 4 and 5 were carried out with commercially available products according to the prior art. Both products contain only about 75% by weight of chromium and about 25% by weight of binding agent. In spite of the high content of binding agent, after 2 minutes in the case of experiment 4 only 9% of the chromium had gone into solution and in the case of experiment 5 only 60% of the chromium. Even after 10 minutes, in the case of experiment 4 only 80% of the chromium had gone into solution and in the case of experiment 5, only 76% of the chromium. Only after 20 minutes with preceding intensive stirring phase is a dissolution of 100% achieved in experiment 4 and, in the case of experiment 6, dissolution is still only 88%. In contradistinction thereto, experiment 3 shows that, in spite of a considerably smaller proportion of binding agent, the chromium has already dissolved substantially completely after 2 minutes. In experiment 6, an additive is used, the binding agent of which consists of potassium aluminium fluoride and aluminium. This combination is in accordance with the prior art (British Patent Specification No. 2,112,020). The experiment results show that, in spite of the higher proportion of binding agent in the case of experiment 6 in comparison with experiment 1, a distinct reduction of the speed of dissolving is observed. In the case of experiment 6, the chromium had only dissolved completely after 20 minutes.

TABLE

| Example | mixing composition in wt. % | | | | | temperature range | % of the theoretical | chromium introduction in % after an experimental time of | | | | |
|---|---|---|---|---|---|---|---|---|---|---|---|---|
| No. | Cr | $KAlF_4$ | KF | $AlF_3$ | | (°C.) | density | 2 min. | 5 min. | 10 min. | 15 min. | 20 min. |
| 1 | 90.9 | 9.1 | — | — | — | 770–800 | 71.4 | 73 | 84 | 98 | 98 | 99 |
| 2 | 88.4 | 11.6 | — | — | — | 780–800 | 71.2 | 85 | 96 | 100 | 100 | 100 |
| 3 | 85.9 | 14.1 | — | — | — | 780–800 | 73.5 | 98 | 100 | 100 | 100 | 100 |
| 4 | 75 | — | — | — | 25 | 780–800 | — | 9 | 39 | 80 | 95 | 100 |
| 5 | 75 | — | 6.5 | 6.5 | 5 | 770–800 | 75.4 | 60 | 74 | 76 | 78 | 88 |
| 6 | 85.9 | 9.1 | — | — | 5 | 770–800 | 73.5 | 58 | 74 | 84 | 84 | 100 |

I claim:

1. Rapidly dissolving additive for molten metal consisting of from 2 to 50% by weight of a component A selected from the group consisting of an alkali metal aluminium tetrafluoride and an alkali metal aluminium tetrafluoridecontaining salt mixture, and 50 to 89% by weight of a component B which consists of at least one alloying metal, the alloying metal being different from the base metal to be alloyed, the components A and B being intimately mixed.

2. Additive according to claim 1, wherein the alkali metal aluminium tetrafluoride is present as an equimolar mixture of alkali metal fluoride and aluminium fluoride.

3. Additive according to claim 1, wherein the alkali metal is sodium, potassium or mixtures thereof.

4. Additive according to claim 3 wherein the alkali metal is potassium.

5. Additive according to claim 1, wherein the alkali metal aluminium tetrafluoride-containing salt mixture consists of at least 50% by weight of alkali metal aluminium tetrafluoride and, as further components, chloride salts, fluoride salts or mixtures thereof.

6. Additive according to claim 1, wherein the component A is present in an amount of 5 to 25% by weight.

7. Additive according to claim 6, wherein the component A is present in an amount of 10 to 20% by weight.

8. Additive according to claim 1, wherein the alloying metal is chromium, manganese, iron or a mixture thereof.

9. Additive according to claim 1, wherein the alloying metal consists of metal alloys or mixtures.

10. Additive according to claim 1, which is in pressed or compacted form.

11. Additive according to claim 10, wherein the compacted or compressed bodies have a thickness of <50 mm.

12. Additive according to claim 1, which is in the form of a filled wire.

13. Process for the production of a rapidly dissolving additive for molten metal comprising intimately mixing in powder form 2 to 50% by weight of a component A selected from the group consisting of an alkali metal aluminium tetrafluoride and an alkali metal aluminium tetrafluoridecontaining salt mixture, and 50 to 98% by weight of a component B consisting of at least one alloying metal, the alloying metal being different from the base metal to be alloyed.

14. Process according to claim 13, wherein component A has a particle size of <1 mm.

15. Process according to claim 14, wherein component A has a particle size of <150 μm.

16. Process according to claim 13, wherein component B has a particle size of <1 mm.

17. Process according to claim 16, wherein component B has a particle size of <150 μm.

18. Process according to claim 13 in which the mixture of components A and B is compacted.

19. Process according to claim 13 in which the mixture of components A and B is enveloped by a wire consisting essentially of the base metal.

20. A method of alloying a molten base metal which comprises adding thereto from about 0.1 to about 25% by weight of an additive consisting of an intimate mixture of from 2 to 50% by weight of a component A which is selected from the group consisting of an alkali metal aluminium tetrafluoride and an alkali metal aluminium tetrafluoridecontaining salt mixture, and from 50 to 98% by weight of a component B which consists of at least one alloying metal, the alloying metal being different from the base metal.

21. A method according to claim 20 in which the additive is in the form of compacted or compressed bodies having a maximum thickness of 50 mm.

22. A method according to claim 20 in which the additive is the form of filled wire particles, the wire consisting essentially of the base metal and the particles have a maximum thickness of 50 mm.

* * * * *